US006971842B2

(12) United States Patent
Luniewski et al.

(10) Patent No.: US 6,971,842 B2
(45) Date of Patent: Dec. 6, 2005

(54) LOW PRESSURE STEAM TURBINE EXHAUST HOOD

(75) Inventors: Alexander Kenneth Luniewski, Gallupville, NY (US); Michael Thomas Hamlin, Burnt Hills, NY (US); Robert Allen Cantelupe, Gloversville, NY (US); Raymond Kenneth Overbaugh, Jr., Berne, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/668,028

(22) Filed: Sep. 22, 2003

(65) Prior Publication Data

US 2005/0063821 A1 Mar. 24, 2005

(51) Int. Cl.[7] ..... F01D 25/26

(52) U.S. Cl. ..... 415/100; 415/108; 415/213.1; 415/214.1; 29/888.02

(58) Field of Search ..... 415/100, 101, 415/102, 103, 108, 207, 211.2, 213.1, 214.1; 29/888.02, 889.2, 889.22

(56) References Cited

U.S. PATENT DOCUMENTS 3,149,470 A * 9/1964 Herzog ..... 60/697
3,520,634 A * 7/1970 Meylan et al. ..... 415/213.1
3,630,635 A * 12/1971 Fatum ..... 415/214.1
3,642,380 A * 2/1972 Saunders ..... 415/213.1
3,942,907 A * 3/1976 Meylan ..... 415/214.1
4,013,378 A 3/1977 Herzog
4,326,832 A * 4/1982 Ikeda et al. ..... 415/108
4,622,819 A 11/1986 Draper et al.
4,673,426 A 6/1987 Silvestri, Jr.
4,803,841 A 2/1989 Hargrove et al.
4,961,310 A 10/1990 Moore et al.
5,290,146 A * 3/1994 Erber ..... 415/213.1
5,518,366 A * 5/1996 Gray ..... 415/211.2
5,779,435 A * 7/1998 Lageder et al. ..... 415/108
6,419,448 B1 * 7/2002 Owczarek ..... 415/207

* cited by examiner

*Primary Examiner*—Edward K. Look
*Assistant Examiner*—Igor Kershteyn
(74) *Attorney, Agent, or Firm*—William Scott Andes; Armstrong Teasdale LLP

(57) ABSTRACT

An exhaust hood for a turbine includes a shell casing, an external support structure, conical corner plates, and a butterfly plate. The shell casing includes an inner surface and an outer surface. The external support structure is coupled to the shell casing outer surface, and provides structural support to said shell casing. The butterfly plate is coupled to the shell casing inner surface for channeling flow into the exhaust hood and subsequently into the condenser. The butterfly plate has a substantially elliptically-shaped cross-sectional profile that facilitates reducing flow separation losses of steam flowing therethrough into the exhaust hood.

17 Claims, 5 Drawing Sheets

LOW PRESSURE STEAM TURBINE EXHAUST HOOD

BACKGROUND OF THE INVENTION

This invention relates generally to steam turbines and more particularly, to flow and pressure distribution in a steam turbine exhaust hood.

At least some known power plants include a low pressure steam turbine (LP) coupled to an intermediate pressure (IP) and/or high pressure (HP) steam turbine to drive a generator. Within known LP turbines, expended steam is channeled into an exhaust hood from the LP turbine. The LP turbine exhaust hood facilitates separating steam under vacuum from atmospheric conditions, while providing support to rotating and stationary turbine components. As is known, the stationary components generally direct the steam towards the rotating components a pre-determined angle to facilitate rotor rotation and thus, power generation.

At least one known LP turbine exhaust hood is fabricated using complex plate metal shapes to form a shell assembly. The shell assembly is then machined to facilitate an interface between internal and external components used for steam turbine construction. The upper and lower halves of the exhaust hood are then coupled along a horizontal joint to form the exhaust hood.

Internal surfaces of the exhaust hood transition the steam flow into a condenser. Moreover, the exhaust hood internal support structures also facilitate separating the steam, as the steam changes direction within the exhaust hood. In addition, such internal support structures facilitate increasing the structural stiffness of the exhaust hood. However, because such internal structural members extend radially inward, steam flowing through the exhaust hoods contacts the protruding structural components. As a result, energy-consuming vortices may be generated downstream from the protruding structural components, which may decrease exhaust hood efficiency.

BRIEF DESCRIPTION OF THE INVENTION

In one aspect, a method of assembling a turbine exhaust hood is provided. The method comprises coupling a support structure to an upper shell casing such that the shell casing is radially inward of the support structure, coupling a butterfly plate to the upper shell casing such that the butterfly plate is substantially concentrically aligned with respect to a steam inlet extending through the upper shell casing, and coupling the upper shell casing to a lower shell casing such that a turbine is housed within the exhaust hood and wherein the butterfly plate is positioned to channel steam flow towards the a lower half of the exhaust hood and subsequently to the condenser during turbine operations.

In another aspect, an exhaust hood for a turbine is provided. The exhaust hood includes a shell casing, an external support structure, and a butterfly plate. The shell casing includes an inner surface and an outer surface. The external support structure is coupled to the shell casing outer surface, and provides structural support to said shell casing. The butterfly plate is coupled to the shell casing inner surface for channeling flow into a lower half of the exhaust hood, and subsequently into the condenser. The butterfly plate has a cross-sectional profile that facilitates reducing flow separation losses of steam flowing therethrough into the exhaust hood lower half and into the condenser.

In a further aspect, a turbine assembly is provided. The turbine assembly includes a turbine and an exhaust hood.

The exhaust hood includes a shell casing, a support structure, and a butterfly plate. The turbine is housed within the exhaust hood. The shell casing includes a radially inner surface and a radially outer surface. The support structure extends across the shell casing outer surface for providing structural support to the shell casing. The butterfly plate is coupled to the shell casing inner surface for channeling flow into a lower half of the exhaust hood, and subsequently into the condenser. The butterfly plate has a cross-sectional profile that facilitates reducing flow separation losses of fluid flowing therethrough towards the exhaust hood lower half and the condenser.

DETAILED DESCRIPTION OF THE INVENTION

Figure 1:
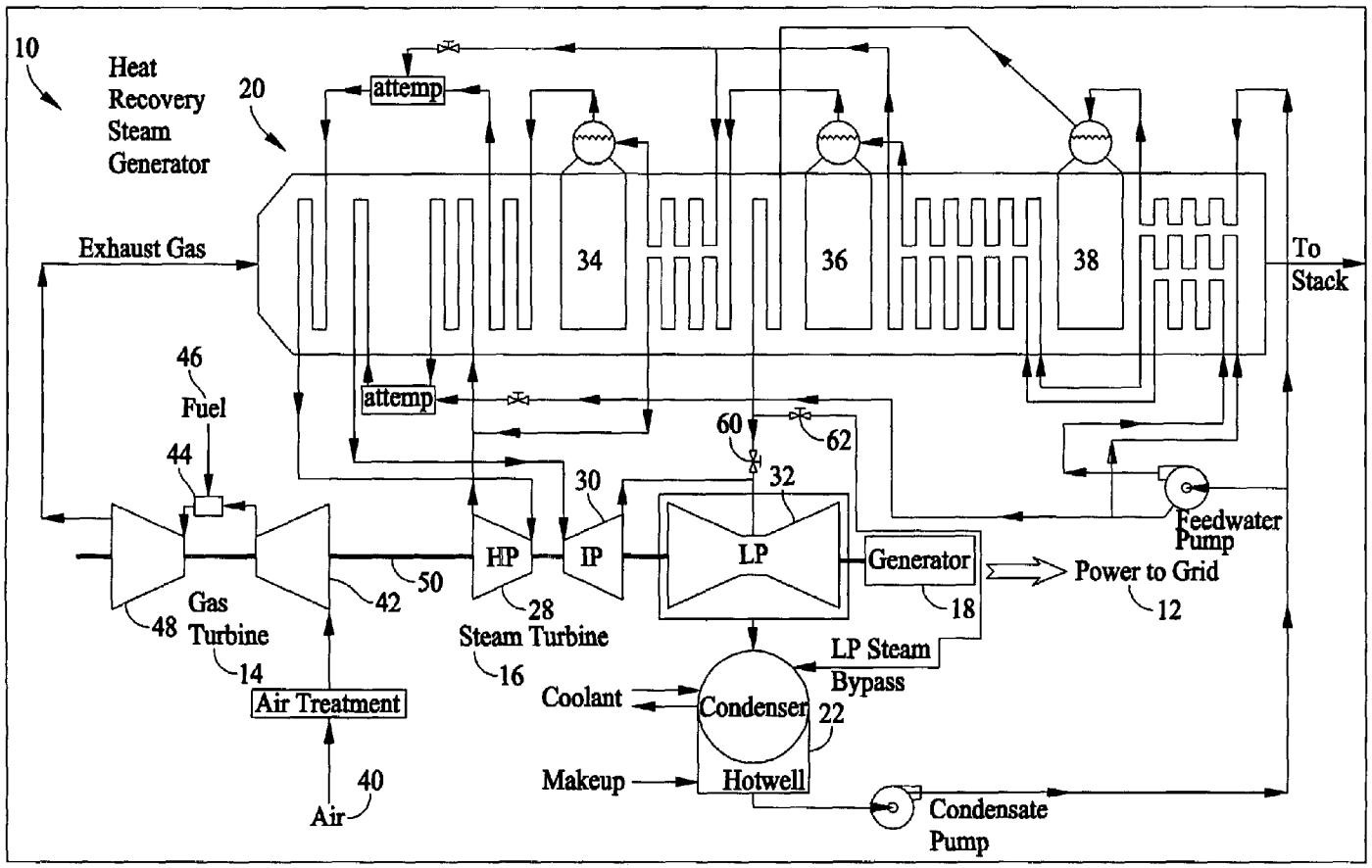
FIG. 1 is a schematic illustration of an exemplary power plant 10.

FIG. 1 is a schematic illustration of an exemplary power plant 10 configured to supply energy to a power grid 12. In the exemplary embodiment, power plant 10 is a multi-pressure, single-shaft combined cycle power plant 10 and includes a gas turbine 14 that may or may not be coupled to a steam turbine assembly 16, and a common generator 18 via a shaft 50. Power plant 10 also includes a heat recovery steam generator (HRSG) 20, a condenser 22, and a plurality of pumps (not shown) that repressurize the condensate supplied to HRSG 20. In the exemplary embodiment, steam turbine assembly 16 includes a High Pressure (HP) turbine section 28, an Intermediate Pressure (IP) turbine section 30, and a Low Pressure (LP) turbine section 32, and HRSG 20 includes a high pressure section 34, an intermediate pressure section 36, and a low pressure section 38. In another embodiment, power plant 10 is a multi-pressure, multi-shaft combined cycle power plant 10, wherein gas turbine 14 is coupled to generator 18 via shaft 50, and steam turbine assembly 16 is coupled to a separate generator (not shown).

In use, ambient air 40 is channeled into a turbine compressor section 42. Compressed air is then directed into a combustion section 44 and mixed with fuel 46, wherein the mixture is ignited, and the resulting combustion gases are channeled towards a turbine section 48 to induce rotation within turbine section 48. Shaft 50 transmits torque produced by gas turbine 14 to a separate generator (not shown) or to the combined steam turbine assembly 16 and generator 18 to either produce electricity, or to supply power to another power consuming load (not shown).

Exhaust heat from gas turbine 14 is introduced into HRSG 20 via an exhaust duct, wherein the exhaust heat is used to convert water supplied from steam turbine condenser 22 into steam for re-admission into steam turbine assembly 16.

Specifically, condensate from condenser 22 is supplied to each multiple pressure level. In the exemplary embodiment, Steam, known as main steam, is generated in a high pressure section 34 of HRSG 20 and is introduced into an inlet or throttle section of HP turbine section 28. The temperature and pressure of the steam decreases as it expands through HP turbine section 28 until it is directed to the cold reheat piping. The cold reheat piping channels the steam to HRSG 20 wherein additional heat is added using a reheater (not shown). The higher energy steam produced, known as hot reheat steam, is directed into an inlet of IP turbine section 30. Steam temperature and pressure decrease as the steam expands through IP turbine 30 and is channeled into LP turbine 32. In one embodiment, steam from HRSG low pressure section 38, also known as admission steam, is supplied to LP turbine 32 via admission valve 60.

Plant 10 also includes a plurality of bypass piping that enables HRSG sections 34, 36, and 38 to be bypassed to condenser 22 during plant start-up operating conditions, and during operating conditions which are not suitable for steam turbine admission. Only the LP bypass, via valve 62 is illustrated, but it should be noted that many variations of multi-pressure combined cycle power systems exist, including, but not limited to, the three pressure reheat system shown in FIG. 1, as well as three pressure non-reheat, two pressure reheat, and two pressure non-reheat cycles, along with numerous variations on equipment design and arrangement. The methods described herein are not limited to the exemplary embodiments illustrated, but rather are applicable to all of the aforementioned embodiments, provided LP steam can either be admitted to LP turbine section 32, as through admission valve 60, or bypassed, such that steam does not enter LP steam turbine section 32, as through LP steam bypass valve 62. After the steam has passed through LP turbine section 32, the steam is discharged through a steam exhaust hood 64 and exhausts to condenser 22 to be condensed to water. The water is returned to HRSG 20 to restart the steam generation cycle again.

Figure 2:
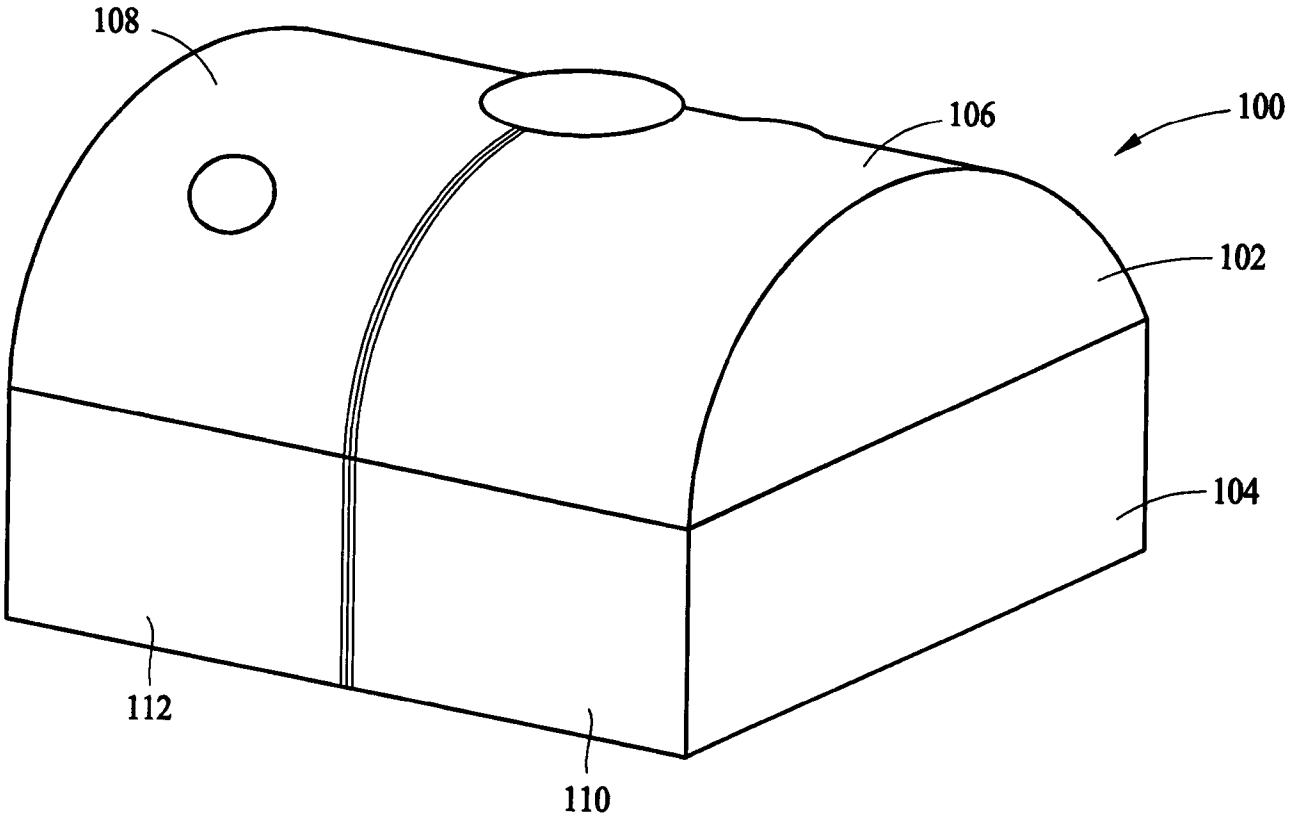
FIG. 2 is a general schematic illustration of an exhaust hood that may be used with the power plant shown in FIG. 1.
Figure 3:
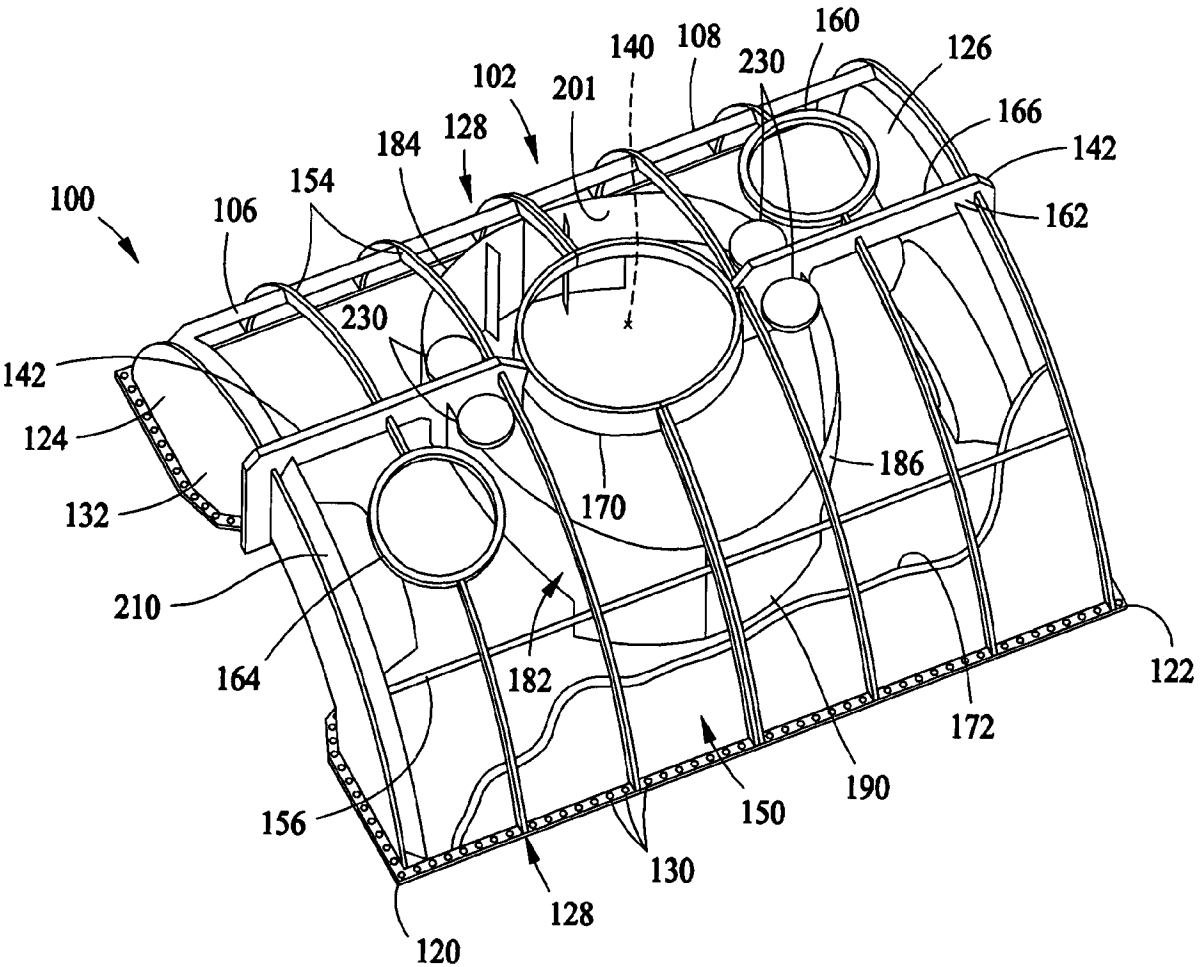
FIG. 3 illustrates a partial cut-away perspective view of an upper half of the exhaust hood shown in FIG. 2 viewed from above the exhaust hood.
Figure 4:
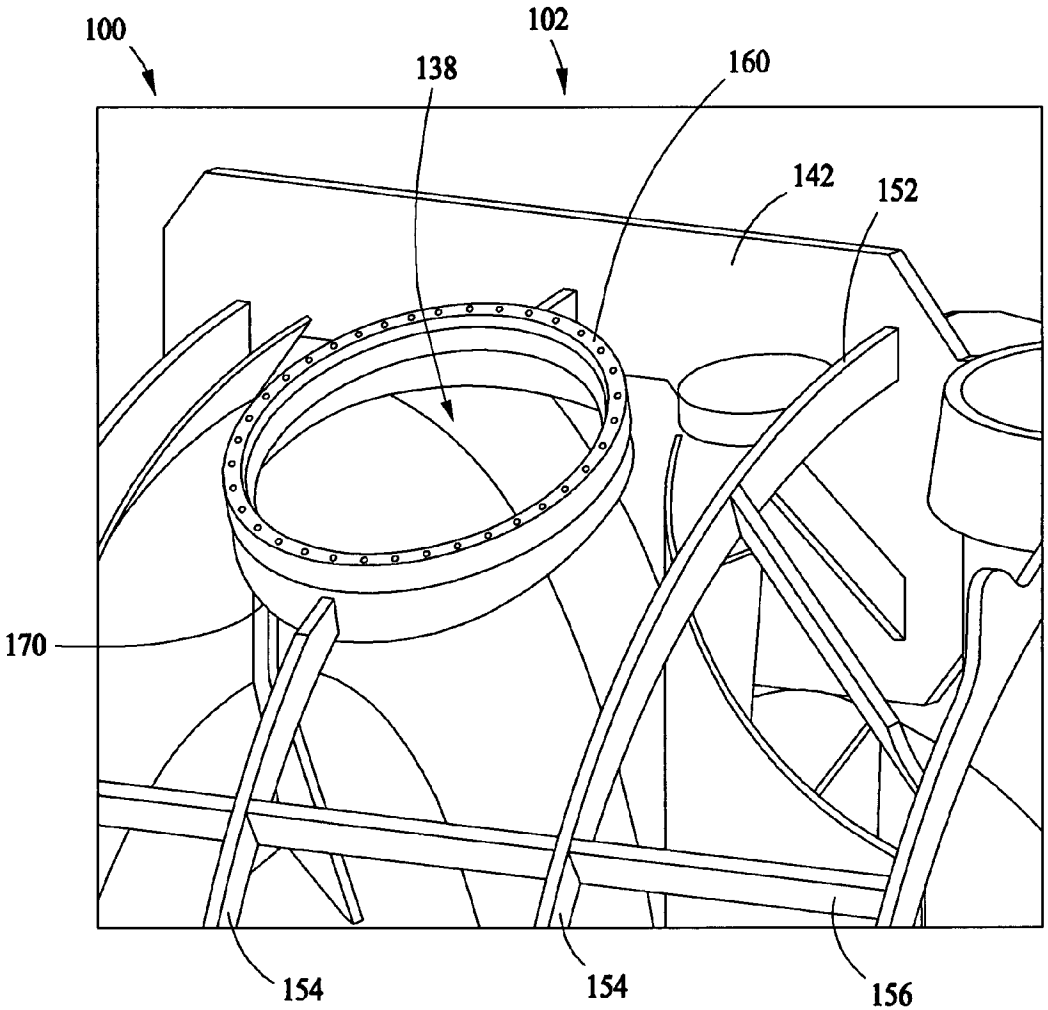
FIG. 4 illustrates an enlarged view of a portion of the upper half of the exhaust hood shown in FIG. 3 and taken along area 4.
Figure 5:
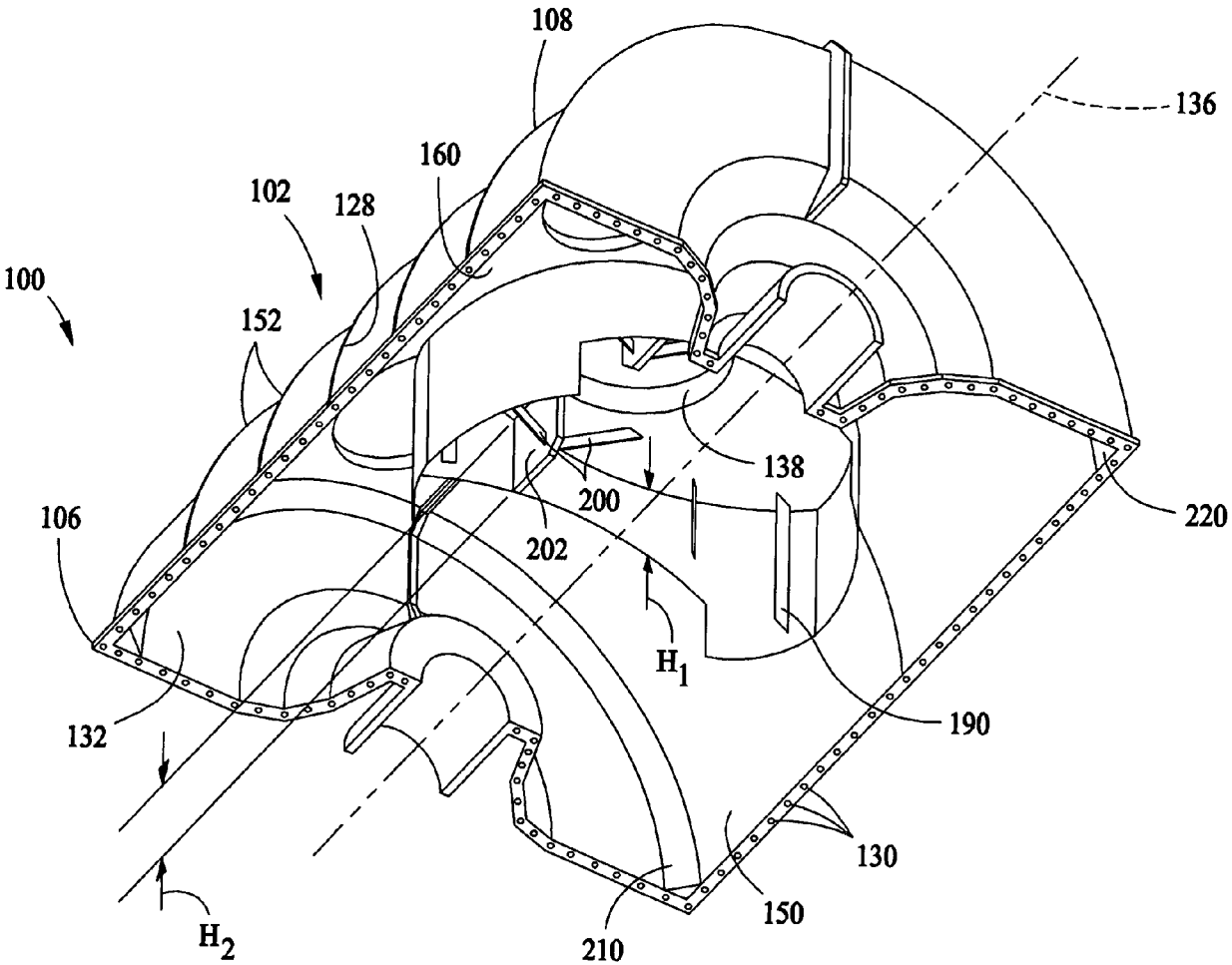
FIG. 5 illustrates a partial cut-away perspective view of the upper half of the exhaust hood shown in FIG. 2 and viewed from below of the exhaust hood.

FIG. 2 is a general schematic illustration of an exhaust hood or shell assembly 100 that may be used with a turbine such as, but not limited to, steam turbine 16 (shown in FIG. 1). FIG. 3 illustrates a partial cut-away perspective view of an upper half of exhaust hood 100, viewed from above exhaust hood 100. FIG. 4 illustrates an enlarged view of a portion of the upper half of exhaust hood 100 taken along area 4. FIG. 5 illustrates a partial cut-away perspective view of exhaust hood 100 viewed from below the upper half of exhaust hood 100.

In the exemplary embodiment, exhaust hood 100 includes an upper shell assembly 102 that is coupled to a lower base shell assembly 104. Upper shell assembly 102 includes a first shell portion 106 that is coupled to a second shell portion 108. In an alternative embodiment, upper shell assembly 102 is of unitary construction and is formed integrally with both shell portions 106 and 108. Lower base shell assembly 104 includes a first base shell portion 110 that is coupled to a second base shell section 112. In an alternative embodiment, lower base shell assembly 104 is of unitary construction and is formed integrally with both shell portions 110 and 112.

Upper shell assembly 102 extends axially between a first end 120 and a second end 122, and laterally between a pair of sides 124 and 126. Ends 120 and 122, and sides 124 and 126 form a frame assembly 128. In the exemplary embodiment, frame assembly 128 includes a plurality of formed openings 130 that are each sized to receive a mechanical coupling device (not shown) therethrough to facilitate mechanically coupling upper shell assembly 102 to lower base shell assembly 104. Upper shell assembly 102 also includes a first substantially semi-circular shaped end cover 132 and a second substantially semi-circular shaped end cover 134. End covers 132 and 134 are each coupled to frame assembly 128 at opposite ends 120 and 122 of upper shell assembly 102. More specifically, each cover 132 and 134 is positioned substantially concentrically with respect to an axis of symmetry 136 extending axially between covers 132 and 134 through upper shell assembly 102.

Upper shell assembly 102 also includes an opening or steam inlet 138 that extends therethrough. A center 140 of opening 138 is aligned substantially concentrically with respect to axis of symmetry 136. In the exemplary embodiment, steam from IP turbine 30 section (shown in FIG. 1) flows through opening 138 towards LP turbine section 32 (shown in FIG. 1). Opening 138 is also concentrically aligned with respect to a center rib 142 that extends between end covers 132 and 134, and along axis of symmetry 136. More specifically, rib 142 does not extend continuously axially between end covers 132 and 134, but rather extends from each respective end cover 132 and 134 to opening 138.

An arcuate shell casing 150 extends across exhaust hood 100. More specifically, shell casing 150 extends axially between exhaust hood first and second ends 120 and 122, respectively, and laterally between exhaust hood sides 124 and 126. An external support frame 152 extends across an outer periphery of shell casing 150 and includes a plurality of arcuate lateral support ribs 154 and a plurality of axial support ribs 156. Frame 152 is also coupled to center rib 142. Rib 142 is oriented such that at least a portion of rib 142 extends radially inward from casing 150 to provide structural support to casing 150. Notably however, rib 142 provides structural support to casing 150 while impeding steam flow within hood 100 less than other ribs used with other known exhaust hoods. In one embodiment, rib 142 extends only approximately three inches radially inward from shell casing 150.

Support frame 152 provide additional structural support to shell casing 150. Lateral support ribs 154 are spaced substantially equidistantly between hood ends 120 and 122, and extend laterally between hood sides 124 and 126. In the exemplary embodiment, adjacent ribs 154 are substantially parallel to each other. Accordingly, the majority of structural support provided to shell casing 150 is provided by externally-mounted structural supports 154 and 152.

More specifically, axial support ribs 156 are spaced substantially equidistantly between hood first side 124 and second side 126, and extend substantially axially between hood ends 120 and 122. In the exemplary embodiment, support ribs 154 and 156 are coupled together in a lattice-shaped arrangement. It should be noted that the size, location, number, and type of ribs 154 and 156 are variably selected to facilitate providing structural support to hood 100, as described herein.

Upper shell assembly 102 also includes a first atmospheric support diaphragm (ARD) support ring 164 that is positioned along a first side 162 of center rib 142, and a second ARD support ring 160 that is positioned on along an opposite second side 166 of center rib 142. Rings 160 and 164 support known atmospheric diaphragms therein. In the exemplary embodiment, a radially inner surface 170 of each ARD support ring 160 and 164 is contoured to substantially match an inner surface contour of shell casing 150, such that each support ring radially inner surface 170 is substantially co-planar with, and forms a substantially smooth inner surface with casing inner surface 172 through hood 100.

Exhaust hood 100 also includes a butterfly plate 182 including a first plate portion 184 and a second plate portion 186 coupled to first portion 184. In the exemplary embodiment, plate portions 184 and 186 are mirror images of each other. In another embodiment, butterfly plate 182 is of unitary construction. More specifically, in the exemplary embodiment, butterfly plate 182 has a substantially elliptical cross-sectional profile. Inlet steam entering opening 138 is directed by an inner cylinder/shell (not shown) through the steampath. When the steam exits the steampath substantially axially, the steam contacts the back shell wall and reverses direction. Butterfly plate 182 and corner plates direct the steam in the upper half of the exhaust hood into the lower half of the exhaust hood and subsequently into the condenser. Additionally, butterfly plate 182 facilitates limiting an amount of exhaust steam, which is at a cooler operating temperature than the inlet steam, from contacting inlet surfaces. Butterfly plate portions 184 and 186 each extend radially inwardly from casing inner surface 172 to a contoured radially inner surface 190 of portions 184 and 186. Accordingly, in the exemplary embodiment, when upper shell assembly portions 106 and 108 are coupled together, portions 184 define the elliptically-shaped cross-sectional profile of butterfly plate 182.

A pair of support structures 200 extend radially inward from an inner surface 201 of each butterfly plate portion 184 and 186. Support structures 200 include a center support rib 202 that extends between each respective plate portion 184 and 186 to opening 138, and a pair of side supports 204 that extend between center support rib 202 and hood inner surface 172. Center support rib 202 has a height $H_1$ that is approximately equal, or less than a height $H_2$ of each plate portion 184 and 186. Accordingly, support structures 200 provide structural support to butterfly plate 182, such that the steam flow path external to plate portions 184 and 186 remains relatively unimpeded.

Exhaust hood 100 also includes a pair of conical corner flow plates 210 and 220 positioned within each respective exhaust hood shell portion 106 and 108 along the transition created between each shell portion 106 and 108, and each respective end cover 132 and 134. Specially, each flow plate 210 and 220 is coupled adjacent each respective end cover 132 and 134 to facilitate providing a smooth steam transition through hood 100, such that steam separation losses that may be caused as the flow direction is changed are facilitated to be minimized.

Exhaust hood 100 also includes a plurality of accesses 230, also referred to as manholes. Accesses 230 are positioned along each side 162 and 166 of center rib 142 to facilitate access into hood 100. More specifically, accesses 230 are positioned between support ribs 154 and 156 to enable an operator to access an inner portion of exhaust hood 100 without contacting support ribs 154 and 156 respectively.

During use, the design of hood 100 facilitates improved internal flow through hood 100 whiles still providing a robust structural integrity for hood 100. Specifically, because the majority of structural components are external to hood 100, exhaust hood losses created when flow contacts protrusions within the flow path are facilitated to be reduced. More specifically, because the because the majority of primary structural components are coupled externally to hood 100 rather than extending through the exhaust hood as is the case with at least some known exhaust hoods, the number of components extending into the steam flow path defined within hood 100 is reduced in comparison to other known exhaust hoods. In one embodiment, hood 100 has at least fifty percent less internal structural members in comparison to other known exhaust hoods. Accordingly, the flow area through exhaust hood 100 is increased, and associated separation losses are decreased, in comparison to other known exhaust hoods. The increased flow area facilitates decreasing flow velocity within exhaust hood 100. In addition, flow plates 210 and 220 facilitate reducing flow separation losses as the flow direction is changed within exhaust hood 100. Moreover, the elliptical profile of butterfly plate 182 also facilitates reducing flow separation losses as the flow enters hood 100 and the direction of the flow is changed within exhaust hood 100.

Exhaust hood 100 also includes a butterfly plate 182 including a first plate portion 184 and a second plate portion 186 coupled to first portion 184. In the exemplary embodiment, plate portions 184 and 186 are mirror images of each other. In another embodiment, butterfly plate 182 is of unitary construction. Butterfly plate portions 184 and 186 each extend radially inwardly from casing inner surface 172 to a contoured radially inner surface 190 of portions 184 and 186. Accordingly, in the exemplary embodiment, when upper shell assembly portions 106 and 108 are coupled together, portions 184 define the elliptically-shaped cross-sectional profile of butterfly plate 182.

The above-described exhaust hood is cost-effective and highly reliable. The hood includes an elliptical butterfly plate that has a reduced flowpath cross-sectional area, that in combination with conical flow plate corners, an external structural frame, and contoured ARD support rings, facilitates minimizing flow separation losses within the exhaust hood. As a result, an operating efficiency of the exhaust hood is facilitated to be enhanced in a cost-effective and reliable manner.

Exemplary embodiments of exhaust hoods are described above in detail. The exhaust hoods and associated components are not limited to the specific embodiments described herein, but rather, components of each exhaust hood may be utilized independently and separately from other components described herein. Each exhaust hood component can also be used in combination with other exhaust hoods.

While the invention has been described in terms of various specific embodiments, those skilled in the art will recognize that the invention can be practiced with modification within the spirit and scope of the claims.

What is claimed is:

1. A method of assembling a turbine exhaust hood, said method comprising:

coupling a support structure to an upper shell casing such that the shell casing is radially inward of the support structure;

coupling an elliptically-shaped butterfly plate to the upper shell casing such that the butterfly plate is substantially concentrically aligned with respect to a steam inlet extending through the upper shell casing;

coupling the upper shell casing to a lower shell casing such that a turbine is housed within the exhaust hood and wherein the butterfly plate is positioned to channel steam flow towards the condenser during turbine operations; and coupling at least one atmospheric diaphragm within an atmospheric diaphragm support ring defined on the upper shell casing.

2. A method in accordance with claim 1 wherein coupling a support structure to the upper shell casing further comprises coupling a center rib to the upper shell casing such that the rib extends at least partially axially between opposing ends of the upper shell casing, and such that the rib extends at least partially radially inward from the shell casing.

3. A method in accordance with claim 1 further comprising coupling at least one corner flow plate within the upper shell casing to facilitate redirecting a direction of steam flowing within said exhaust hood.

4. A method in accordance with claim 1 wherein coupling at least one atmospheric diaphragm within an atmospheric diaphragm support ring further comprises contouring a radially inner surface of the atmospheric diaphragm support ring to substantially match a contour of the upper shell casing.

5. A turbine exhaust hood comprising:

a shell casing comprising an inner surface and an outer surface;

an external support structure coupled to said shell casing outer surface, said external support structure provides structural support to said shell casing;

a butterfly plate coupled to said shell casing inner surface for channeling flow into said exhaust hood, said butterfly plate having a substantially elliptically-shaped cross-sectional profile that facilitates reducing flow separation losses of fluid flow flowing therethrough into said exhaust hood; and at least one corner flow plate having a conical cross-sectional profile that is configured to facilitate redirecting a direction of fluid flow flowing within said exhaust hood.

6. An exhaust hood in accordance with claim 5 wherein said at least one corner flow plate has a conical cross-sectional profile.

7. An exhaust hood in accordance with claim 5 further comprising:

a rib extending at least partially axially across said exhaust hood along an axis of symmetry of said exhaust hood, said rib comprising a first side and an opposite second side;

a first atmospheric diaphragm support ring positioned at a distance from said rib first side; and a second atmospheric diaphragm support ring positioned at a distance from said rib second side.

8. An exhaust hood in accordance with claim 7 wherein at least one of said first atmospheric diaphragm support ring and said second atmospheric diaphragm support ring comprises a radial inner surface that is contoured to substantially match a contour of a portion of said shell casing.

9. An exhaust hood in accordance with claim 5 further comprising:

a first access opening positioned a distance from an axial axis of symmetry extending through said exhaust hood; and a second access opening positioned on an opposite distance from said axis of symmetry, said first and second access openings extending through said exhaust hood shell casing.

10. An exhaust hood in accordance with claim 5 wherein said external support structure comprises a plurality of ribs coupled together to form a lattice-shaped assembly.

11. A turbine assembly comprising:

a turbine; and an exhaust hood comprising a shell casing, a support structure, at least one flow plate, and a butterfly plate, said turbine housed within said exhaust hood, said shell casing comprising a radially inner surface and a radially outer surface, said support structure extending across said shell casing outer surface for providing structural support to said shell casing, said butterfly plate coupled to said shell casing inner surface for channeling flow into said exhaust hood, said butterfly plate having a cross-sectional profile that facilitates reducing flow separation losses of fluid flowing therethrough towards said turbine, said at least one flow plate is coupled to said shell casing to facilitate changing a flow direction of steam flowing through the exhaust hood such that flow separation losses are facilitated to be reduced.

12. A turbine assembly in accordance with claim 11 wherein said at least one flow plate has a conical cross-sectional profile.

13. A turbine assembly in accordance with claim 11 wherein said exhaust hood further comprises:

a rib extending at least partially axially across said exhaust hood along an axis of symmetry of said exhaust hood, said rib comprising a first side and an opposite second side; and at least one atmospheric support diaphragm positioned a distance from said axis of symmetry, said atmospheric support diaphragm configured to reduce an operating pressure within said exhaust hood.

14. A turbine assembly in accordance with claim 13 wherein said at least one atmospheric support diaphragm comprises a radial inner surface and a radial outer surface, said radial inner surface contoured to substantially match a contour of said shell casing.

15. A turbine assembly in accordance with claim 11 wherein said exhaust hood support structure facilitates reducing flow separation losses of steam flowing through said exhaust hood.

16. A turbine assembly in accordance with claim 11 wherein said exhaust hood further comprises at least one access opening extending through said shell casing, said at least one access opening positioned a distance from an axial axis of symmetry extending through said exhaust hood.

17. A turbine assembly in accordance with claim 11 wherein said exhaust hood support structure is coupled together in a lattice-shaped arrangement extending across said exhaust hood.

* * * * *